US011598031B2

(12) United States Patent
Crandall et al.

(10) Patent No.: US 11,598,031 B2
(45) Date of Patent: Mar. 7, 2023

(54) ARTICLE INCLUDING MULTI-COMPONENT FIBERS AND HOLLOW CERAMIC MICROSPHERES AND METHODS OF MAKING AND USING THE SAME

(75) Inventors: Michael D. Crandall, North Oaks, MN (US); Ignatius A. Kadoma, Cottage Grove, MN (US); Andrew J. Peterson, White Bear Lake, MN (US); Yong K. Wu, Woodbury, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 1356 days.

(21) Appl. No.: 14/131,342

(22) PCT Filed: Jul. 5, 2012

(86) PCT No.: PCT/US2012/045491

§ 371 (c)(1),
(2), (4) Date: Jan. 7, 2014

(87) PCT Pub. No.: WO2013/006666

PCT Pub. Date: Jan. 10, 2013

(65) Prior Publication Data

US 2014/0141676 A1 May 22, 2014

Related U.S. Application Data

(60) Provisional application No. 61/505,142, filed on Jul. 7, 2011.

(51) Int. Cl.
*D04H 1/413* (2012.01)
*D04H 1/4334* (2012.01)
(Continued)

(52) U.S. Cl.
CPC ..... *D04H 1/413* (2013.01); *D01F 8/04* (2013.01); *D04H 1/4291* (2013.01);
(Continued)

(58) Field of Classification Search
CPC ..... D04H 1/413; D04H 1/4382; D04H 1/541; D04H 1/54; E04B 1/76; E04B 2001/742; E04B 2001/7687
(Continued)

(56) References Cited

U.S. PATENT DOCUMENTS 2,978,340 A 4/1961 Veatch
3,030,215 A 4/1962 Veatch
(Continued)

FOREIGN PATENT DOCUMENTS

DE 102005041423 3/2006
EP 0265221 4/1988
(Continued)

OTHER PUBLICATIONS

Belgacem, Mohamed and Alessandro Gandini. (2008). Monomers, Polymers and Composites from Renewable Resources. Elsevier.*
(Continued)

*Primary Examiner* — Jennifer A Gillett
(74) *Attorney, Agent, or Firm* — Thomas M. Spielbauer; Kathleen B. Gross

(57) ABSTRACT

An article comprising hollow ceramic microspheres and multi-component fibers is disclosed. The multi-component fibers are adhered together, and the hollow ceramic microspheres are adhered to external surfaces of the multi-component fibers. A method of making the article and use of the article for insulation are also disclosed.

20 Claims, 3 Drawing Sheets

(51) Int. Cl.

| | |
|---|---|
| ***D04H 1/435*** | (2012.01) |
| ***D04H 1/4291*** | (2012.01) |
| ***D04H 1/4358*** | (2012.01) |
| ***D01F 8/04*** | (2006.01) |
| ***D04H 1/4382*** | (2012.01) |
| ***D04H 1/541*** | (2012.01) |
| ***E04B 1/76*** | (2006.01) |
| *E04B 1/74* | (2006.01) |

(52) U.S. Cl.
CPC ..... *D04H 1/435* (2013.01); *D04H 1/4334* (2013.01); *D04H 1/4358* (2013.01); *D04H 1/43828* (2020.05); *D04H 1/43838* (2020.05); *D04H 1/5412* (2020.05); *E04B 1/76* (2013.01); *E04B 2001/742* (2013.01); *E04B 2001/7687* (2013.01); *Y10T 442/622* (2015.04); *Y10T 442/692* (2015.04)

(58) Field of Classification Search
USPC ..... 442/361–365, 189–191; 428/364–370, 428/373, 903
See application file for complete search history.

(56) References Cited

U.S. PATENT DOCUMENTS

| | | | | |
|---|---|---|---|---|
| 3,129,086 | A | 4/1964 | Veatch | |
| 3,230,064 | A | 1/1966 | Veatch | |
| 3,365,315 | A | 1/1968 | Beck | |
| 3,401,491 | A | 9/1968 | Schnabel | |
| 3,998,988 | A | 12/1976 | Shimomai | |
| 4,391,646 | A | 7/1983 | Howell | |
| 4,406,850 | A | 9/1983 | Hills | |
| 4,767,726 | A | 8/1988 | Marshall | |
| 5,082,720 | A | 1/1992 | Hayes | |
| 5,304,415 | A * | 4/1994 | Kurihara | B32B 5/30 428/328 |
| 5,411,693 | A | 5/1995 | Wust, Jr. | |
| 5,458,972 | A | 10/1995 | Hagen | |
| 5,486,410 | A * | 1/1996 | Groeger | A62D 5/00 442/353 |
| 5,521,008 | A | 5/1996 | Lieberman | |
| 5,618,479 | A | 4/1997 | Lijten | |
| 5,786,059 | A | 7/1998 | Frank et al. | |
| 5,811,186 | A | 9/1998 | Martin | |
| 5,851,647 | A | 12/1998 | Foster | |
| 5,882,517 | A | 3/1999 | Chen | |
| 5,972,463 | A | 10/1999 | Martin | |
| 5,989,004 | A | 11/1999 | Cook | |
| 6,017,831 | A | 1/2000 | Beardsley | |
| 6,017,837 | A | 1/2000 | Nagashima et al. | |
| 6,095,910 | A * | 8/2000 | Luedeke | B24B 29/005 451/359 |
| 6,391,443 | B1 | 5/2002 | Terada | |
| 6,455,606 | B1 | 9/2002 | Kaku et al. | |
| 6,686,303 | B1 | 2/2004 | Haynes | |
| 7,112,272 | B2 | 9/2006 | Hughes | |
| 7,371,701 | B2 | 5/2008 | Inagaki | |
| 7,655,070 | B1 * | 2/2010 | Dallas | B01D 39/04 95/154 |
| 7,666,505 | B2 | 2/2010 | Datta et al. | |
| 8,127,510 | B2 | 3/2012 | Wagner | |
| 8,353,344 | B2 | 1/2013 | Carlson | |
| 2002/0060012 | A1 | 5/2002 | Berbner | |
| 2002/0106501 | A1 | 8/2002 | Debe | |
| 2002/0177379 | A1 | 11/2002 | Abed | |
| 2003/0114066 | A1 | 6/2003 | Clark | |
| 2003/0228460 | A1 * | 12/2003 | Ahluwalia | A47C 31/001 428/315.5 |
| 2004/0077738 | A1 * | 4/2004 | Field | B01J 13/0091 521/50 |
| 2004/0092191 | A1 | 5/2004 | Bansal | |
| 2006/0063457 | A1 | 3/2006 | Matsui | |
| 2006/0122049 | A1 | 6/2006 | Marshall | |
| 2008/0230309 | A1 * | 9/2008 | Fox | B32B 5/26 181/286 |
| 2010/0058697 | A1 * | 3/2010 | Wagner | E04B 1/7604 52/404.1 |
| 2010/0092746 | A1 * | 4/2010 | Coant | B24D 3/00 428/219 |
| 2010/0159770 | A1 | 6/2010 | Walser | |
| 2010/0272994 | A1 | 10/2010 | Carlson | |
| 2010/0288500 | A1 * | 11/2010 | Carlson | C09K 8/035 166/308.1 |
| 2010/0320029 | A1 * | 12/2010 | Cao | E04B 9/001 181/286 |
| 2014/0138305 | A1 | 5/2014 | Crandall | |

FOREIGN PATENT DOCUMENTS

| | | | | |
|---|---|---|---|---|
| EP | 0656465 | | 6/1995 | |
| EP | 0666095 | | 8/1995 | |
| EP | 1291464 | | 3/2003 | |
| EP | 2003235 | | 12/2008 | |
| JP | 10-240269 | | 9/1998 | |
| JP | 2001-98427 | | 4/2001 | |
| JP | 2001-240809 | | 9/2001 | |
| JP | 2003-193332 | | 7/2003 | |
| JP | 2003-286661 | | 10/2003 | |
| JP | 2006-214052 | | 8/2006 | |
| JP | 2008-128168 | | 6/2008 | |
| WO | WO 98/03306 | * | 1/1998 | B24D 3/28 |
| WO | 2000-37218 | | 6/2000 | |
| WO | 2008-103821 | | 8/2008 | |
| WO | 2009-079231 | | 6/2009 | |
| WO | WO 2009079315 A2 | * | 6/2009 | D04H 1/42 |
| WO | 2010-045053 | | 4/2010 | |
| WO | 2010-075248 | | 7/2010 | |

OTHER PUBLICATIONS

Nishino, Takashi et al. Elastic modulus of the crystallin regions of tehylene-vinyl alcohol copolymers, Polymers vol. 36 No. 5, pp. 959-966. 1995.*

Density vs R-Value for Common Insulation Materials, ASHRAE Handbook of Fundamentals, 2005 edition, p. 23.15, retrieved from www.builditsolar.com/References/DensityvsRValue.htm.*

Straube, John, Thermal Metrics for High Performance Enclosure Walls: The Limitations of R-Value, Research Report 0901, Building Science Press, 2009.*

International Search for PCT International Application No. PCT/US2012/045491, dated Aug. 31, 2012, 5 pages.

Supplementary European Search Report, Application No. EP 12 80 7874, dated Feb. 4, 2015, 2 pages.

The People's Republic of China Search Report, Application No. 201280033747.6, dated Apr. 23, 2015, 1 page.

Shen, "Surface Chemical Functional Groups Modification of Porous Carbon", Recent Patents on Chemical Engineering, 2008, vol. 1, pp. 27-40.

* cited by examiner

ARTICLE INCLUDING MULTI-COMPONENT FIBERS AND HOLLOW CERAMIC MICROSPHERES AND METHODS OF MAKING AND USING THE SAME

CROSS-REFERENCE TO RELATED APPLICATION

This application is a national stage filing under 35 U.S.C. 371 of PCT/US2012/045491, filed Jul. 5, 2012, which claims priority to U.S. Provisional Application No. 61/505,142, filed Jul. 7, 2011, the disclosure of which is incorporated by reference in its entirety herein.

BACKGROUND

Various multi-component fibers are known. Examples include fibers that have a low temperature melting or softening sheath covering a higher melting core. Multi-component structures may be useful, for example, for fiber bonding, wherein the sheath, for example, when melted or softened serves as a bonding agent for the core.

Some articles including fibers and particles are known. In some cases, such articles are made from multi-component fibers where one component melts and coalesces. In these cases, the particles are located at the junction points where fibers contact one another. See, for example, International Patent Application Publication No. WO 2010/045053 (Coant et al.). Some abrasive articles including multi-component fibers and abrasive particles have been described. See, for example, U.S. Pat. No. 5,082,720 (Hayes); U.S. Pat. No. 5,972,463 (Martin et al.); and U.S. Pat. No. 6,017,831 (Beardsley et al.).

In other technologies, hollow ceramic microspheres are widely used in industry, for example, as additives to polymeric compounds. Common hollow ceramic microspheres include glass bubbles having an average diameter of less than about 500 micrometers, which are also commonly known as "glass microbubbles", "hollow glass microspheres", or "hollow glass beads". In many industries, hollow ceramic microspheres are useful, for example, for lowering weight and improving processing, dimensional stability, and flow properties of a polymeric compound. Syntactic foams containing hollow ceramic microspheres dispersed in a continuous matrix of polymeric resin are useful, for example, as insulation in a variety of applications due in part to their low thermal conductivities.

SUMMARY

The present disclosure provides, for example, articles including multi-component fibers and hollow ceramic microspheres. The multi-component fibers are adhered together, and the hollow ceramic microspheres are adhered to the external surfaces of at least some of the multi-component fibers. The articles are useful, for example, as insulation of various types. In the method of making the articles disclosed herein, a mixture of fibers and hollow ceramic microspheres is heated to a temperature where the first polymeric composition has an elastic modulus of less than $3\times10^5$ N/m$^2$ when measured at one hertz. At such a temperature, the first polymeric composition becomes tacky and adheres the multi-component fibers together and adheres the hollow ceramic microspheres to the external surfaces of the multi-component fibers.

In one aspect, the present disclosure provides an article including hollow ceramic microspheres and multi-component fibers. The multi-component fibers have external surfaces and include at least a first polymeric composition and a second polymeric composition, wherein at least a portion of the external surfaces of the multi-component fibers comprises the first polymeric composition. The multi-component fibers are adhered together, and the hollow ceramic microspheres are adhered at least to the first polymeric composition on the external surfaces of at least some of the multi-component fibers.

In another aspect, the present disclosure provides use of the article described above for insulation (e.g., at least one of thermal insulation, acoustic insulation, or electrical insulation).

In another aspect, the present disclosure provides a method of making an article, for example, for insulation, the method comprising:

providing a mixture of hollow ceramic microspheres and multi-component fibers, the multi-component fibers comprising at least a first polymeric composition and a second polymeric composition; and heating the mixture to a temperature at which the multi-component fibers are non-fusing and at which the first polymeric composition has an elastic modulus of less than $3\times10^5$ N/m$^2$ at a temperature of at least 80° C. measured at a frequency of one hertz.

Exemplary embodiments of fibers described herein include those having a core and an external surface, the core comprising the second thermoplastic composition. In some embodiments, for example, the fiber includes a core comprising the second thermoplastic composition and a sheath comprising the first thermoplastic composition surrounding the core.

Consolidation of hollow ceramic microspheres by adhesive multi-component fibers as described herein can form shaped articles with very high hollow microsphere loading, which are useful for a variety of applications. For example, articles disclosed herein are useful as very light weight thermal insulation materials and sound damping materials, which are typically highly flame resistant. Because of the combination of beneficial properties typically associated with them, the articles disclosed herein may be useful, for example, in the transportation industries, such as aerospace and automotive.

In this application, terms such as "a", "an" and "the" are not intended to refer to only a singular entity, but include the general class of which a specific example may be used for illustration. The terms "a", "an", and "the" are used interchangeably with the term "at least one". The phrases "at least one of" and "comprises at least one of" followed by a list refers to any one of the items in the list and any combination of two or more items in the list. All numerical ranges are inclusive of their endpoints and non-integral values between the endpoints unless otherwise stated.

The above summary of the present disclosure is not intended to describe each disclosed embodiment or every implementation of the present disclosure. The description that follows more particularly exemplifies illustrative embodiments. It is to be understood, therefore, that the drawings and following description are for illustration purposes only and should not be read in a manner that would unduly limit the scope of this disclosure.

BRIEF DESCRIPTION OF THE DRAWINGS

For a more complete understanding of the features and advantages of the present disclosure, reference is now made to the detailed description along with the accompanying figures and in which.

DETAILED DESCRIPTION

Figure 1:
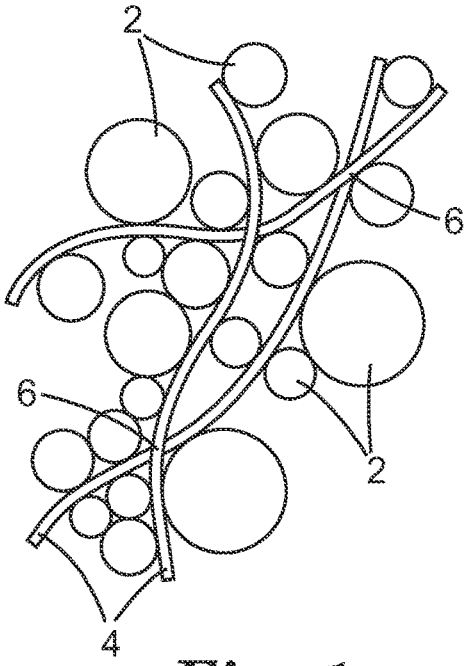
FIG. 1 is a partial schematic view of an exemplary article according to the present disclosure.

FIG. 1 illustrates a portion of an exemplary article according to and/or made according to the present disclosure. The article includes multi-component fibers 4 and hollow ceramic microspheres 2. The multi-component fibers are adhered to one another (e.g., autogenously bonded) at junction points 6, and the hollow ceramic microspheres 2 are adhered on the external surfaces of at least some of the multi-component fibers 4.

In some embodiments, including the embodiment illustrated in FIG. 1, the hollow ceramic microspheres 2 are located along the lengths of the multi-component fibers 4, which means that the hollow ceramic microspheres are not located only at the junction points 6 of the fibers. In some embodiments, hollow ceramic microspheres are located substantially along the entire length of the multi-component fibers. The hollow ceramic microspheres may be randomly distributed along the entire length of the multi-component fibers. In these embodiments, the hollow ceramic microspheres need not cover the entire external surface of the multi-component fibers. The hollow ceramic microspheres may be uniformly distributed, or not, depending, for example, on the level of mixing of the multi-component fibers and the hollow ceramic microspheres, as described below, and the size distribution of hollow ceramic microspheres.

In some embodiments, including the embodiment illustrated in FIG. 1, the hollow ceramic microspheres 2 are directly attached to the external surfaces of at least some of the multi-component fibers 4. "Directly attached" means that there is no adhesive or other binder between the hollow ceramic microspheres and the external surface of the fibers. The first polymeric composition in the multi-component fibers typically functions as an adhesive that holds the fibers together and adheres the hollow ceramic microspheres to the fibers.

Fibers useful for the articles disclosed herein and in the mixtures in the method of making an article disclosed herein include a variety of cross-sectional shapes. Useful fibers include those having at least one cross-sectional shape selected from the group consisting of circular, prismatic, cylindrical, lobed, rectangular, polygonal, or dog-boned. The fibers may be hollow or not hollow, and they may be straight or have an undulating shape. Differences in cross-sectional shape allow for control of active surface area, mechanical properties, and interaction with hollow ceramic microspheres or other components. In some embodiments, the fiber useful for practicing the present disclosure has a circular cross-section or a rectangular cross-section. Fibers having a generally rectangular cross-section shape are also typically known as ribbons. Fibers are useful, for example, because they provide large surface areas relative the volume they displace.

Figure 2A:
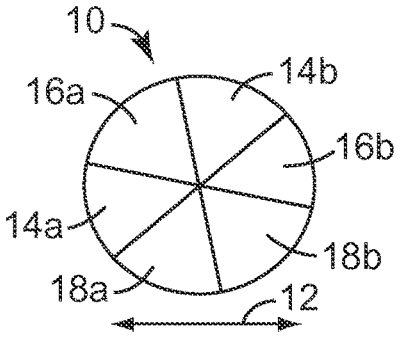
FIGS. 2A-2D are schematic cross-sections of four exemplary fibers described herein.
Figure 2B:
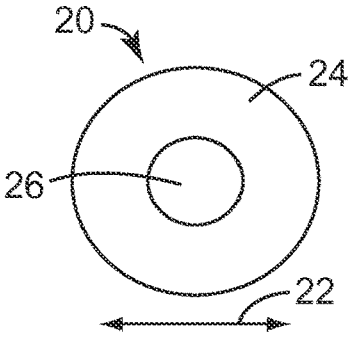
Figure 2C:
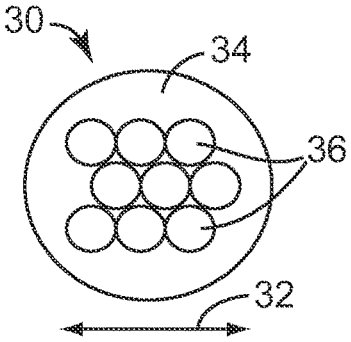
Figure 2D:
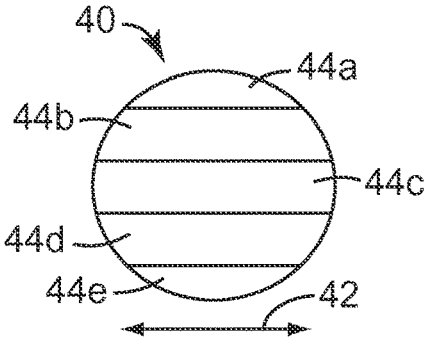

Exemplary embodiments of multi-component fibers useful for practicing the present disclosure include those with cross-sections illustrated in FIGS. 2A-2D. A core-sheath configuration, as shown in FIG. 2B or 2C, may be useful, for example, because of the large surface area of the sheath. In these configurations, the external surface of the fiber is typically made from a single composition. It is within the scope of the present disclosure for the core-sheath configurations to have multiple sheaths. Other configurations, for example, as shown in FIGS. 2A and 2D provide options that can be selected depending on the intended application. In the segmented pie wedge (see, e.g., FIG. 2A) and the layered (see, e.g., FIG. 2D) configurations, typically the external surface is made from more than one composition.

Referring to FIG. 2A, a pie-wedge fiber 10 has a circular cross-section 12, a first polymeric composition located in regions 16*a* and 16*b*, and a second polymeric composition located in regions 14*a* and 14*b*. Other regions in the fiber (18*a* and 18*b*) may include a third component (e.g., a third, different polymeric composition) or may independently include the first polymeric composition or the second polymeric composition.

In FIG. 2B, fiber 20 has circular cross-section 22, sheath 24 of a first polymeric composition, and core 26 of a second polymeric composition. FIG. 2C shows fiber 30 having a circular cross-section 32 and a core-sheath structure with sheath 34 of a first polymeric composition and plurality of cores 36 of a second polymeric composition.

FIG. 2D shows fiber 40 having circular cross-section 42, with five layered regions 44*a*, 44*b*, 44*c*, 44*d*, 44*e*, which comprise alternatively at least the first polymeric composition and the second polymeric composition. Optionally, a third, different polymeric composition may be included in at least one of the layers.

Figure 3A:
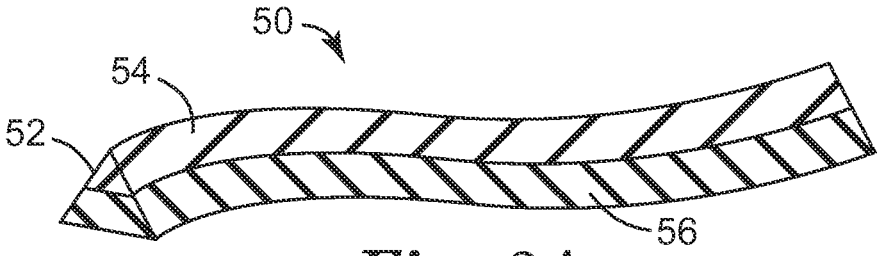
FIGS. 3A-3E are schematic perspective views of various fibers described herein.

FIGS. 3A-3E illustrate perspective views of various embodiments of multi-component fibers useful for practicing the present disclosure. FIG. 3A illustrates a fiber 50 having a triangular cross-section 52. In the illustrated embodiment, the first polymeric composition 54 exists in one region, and the second polymeric composition 56 is positioned adjacent the first polymeric composition 54.

Figure 3B:
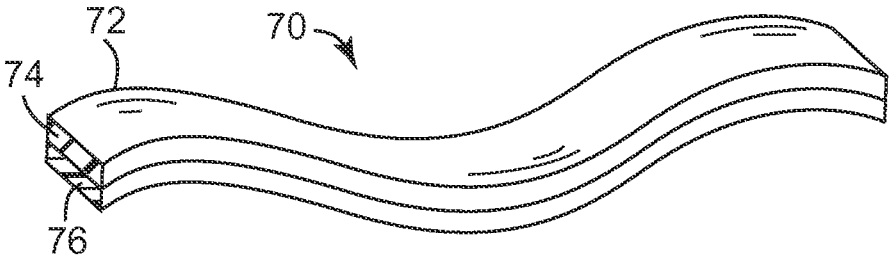

FIG. 3B illustrates a ribbon-shaped embodiment 70 having a generally rectangular cross-section and an undulating shape 72. In the illustrated embodiment, a first layer 74 comprises the first polymeric composition, while a second layer 76 comprises the second polymeric composition.

Figure 3C:
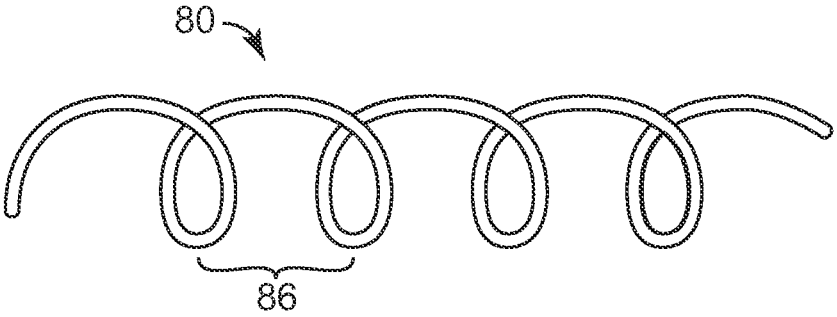

FIG. 3C illustrates a coiled or crimped multi-component fiber 80 useful for articles according to the present disclosure. The distance between coils, 86, may be adjusted according to the properties desired.

Figure 3D:
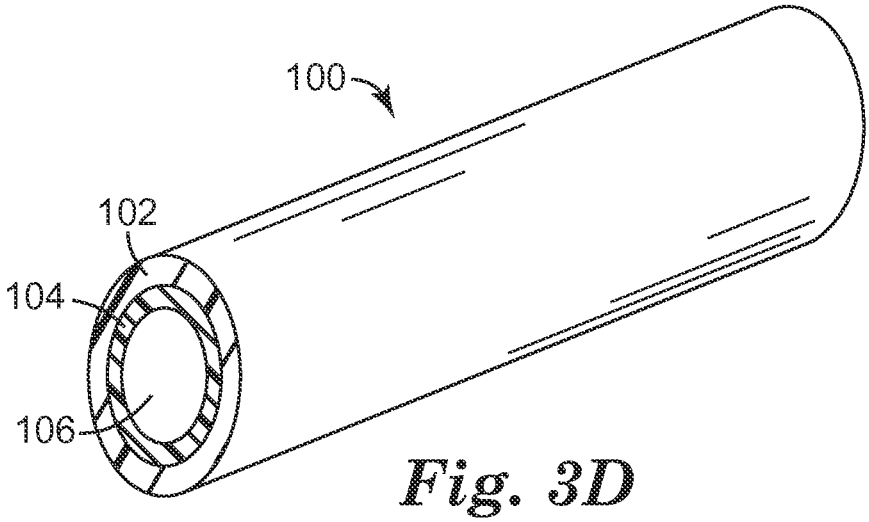

FIG. 3D illustrates a fiber 100 having a cylindrical shape, and having a first annular component 102, a second annular component 104, the latter component defining hollow core 106. The first and second annular components typically comprise the first polymeric composition and the second polymeric composition, respectively. The hollow core 106 may optionally be partially or fully filled with an additive (e.g., a curing agent or tackifier) for one of the annular components 102, 104.

Figure 3E:
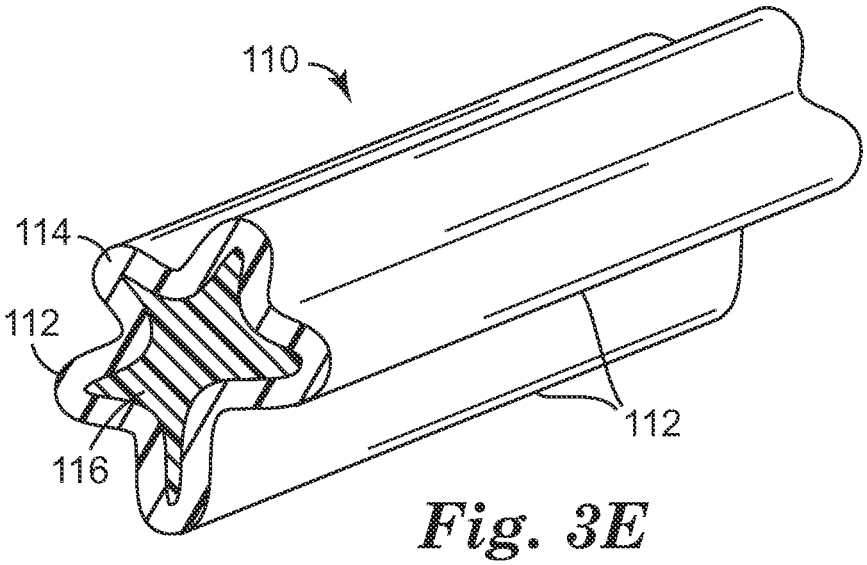

FIG. 3E illustrates a fiber with a lobed-structure 110, the example shown having five lobes 112 with outer portions 114 and an interior portion 116. The outer portions 114 and interior portion 116 typically comprise the first polymeric composition and the second polymeric composition, respectively.

The aspect ratio of multi-component fibers described herein may be, for example, at least 3:1, 4:1, 5:1, 10:1, 25:1, 50:1, 75:1, 100:1, 150:1, 200:1, 250:1, 500:1, 1000:1, or more; or in a range from 2:1 to 1000:1. Larger aspect ratios (e.g., having aspect ratios of 10:1 or more) may more easily allow the formation of a network of multi-component fibers and may allow for more hollow ceramic microspheres to be adhered to the external surfaces of the fibers.

Multi-component fibers useful for the articles and methods according to the present disclosure include those having a length up to 60 mm, in some embodiments, in a range from 2 mm to 60 mm, 3 mm to 40 mm, 2 mm to 30 mm, or 3 mm to 20 mm. Typically, the multi-component fibers disclosed herein have a maximum cross-sectional dimension up to 100 (in some embodiments, up to 90, 80, 70, 60, 50, 40, or 30) micrometers. For example, the fiber may have a circular cross-section with an average diameter in a range from 1 micrometer to 100 micrometers, 1 micrometer to 60 micrometers, 10 micrometers to 50 micrometers, 10 micrometers to 30 micrometers, or 17 micrometers to 23 micrometers. In another example, the fiber may have a rectangular cross-section with an average length (i.e., longer cross-sectional dimension) in a range from 1 micrometer to 100 micrometers, 1 micrometer to 60 micrometers, 10 micrometers to 50 micrometers, 10 micrometers to 30 micrometers, or 17 micrometers to 23 micrometers.

In some embodiments, multi-component fibers useful for the articles and methods according to the present disclosure are non-fusing at a temperature of at least 110° C. (in some embodiments, at least 120° C., 125° C., 150° C., or even at least 160° C.). In some embodiments, multi-component fibers useful for the articles and methods according to the present disclosure are non-fusing at a temperature of up to 200° C. "Non-fusing" fibers can autogenously bond (i.e., bond without the addition of pressure between fibers) without significant loss of architecture, for example, a core-sheath configuration. The spatial relationship between the first polymeric composition, the second polymeric composition, and optionally any other component of the fiber is generally retained in non-fusing fibers. Typically multi-component fibers (e.g., fibers with a core-sheath configuration) undergo so much flow of the sheath composition during autogenous bonding that the core-sheath structure is lost as the sheath composition becomes concentrated at fiber junctions and the core composition is exposed elsewhere. That is, typically multi-component fibers are fusing fibers. This loss of structure typically results in the loss of the functionality of the fiber provided by the sheath component. In non-fusing fibers (e.g., core-sheath fibers) heat causes little or no flow of the sheath composition so that the sheath functionality is retained along the majority of the multi-component fibers.

To evaluate whether fibers are non-fusing at a particular temperature, the following test method is used. The fibers are cut to 6 mm lengths, separated, and formed into a flat tuft of interlocking fibers. The larger cross-sectional dimension (e.g., the diameter for a circular cross-section) of twenty of the cut and separated fibers is measured and the median recorded. The tufts of the fibers are heated in a conventional vented convection oven for 5 minutes at the selected test temperature. Twenty individual separate fibers are then selected and their larger cross-section dimension (e.g., diameter) measured and the median recorded. The fibers are designated as "non-fusing" if there is less than 20% change in the measured dimension after the heating.

Typically, the dimensions of the multi-component fibers used together in the article and/or method according to the present disclosure, and components making up the fibers are generally about the same, although use of fibers with even significant differences in compositions and/or dimensions may also be useful. In some applications, it may be desirable to use two or more different groups of multi-component fibers (e.g., at least one different polymer or resin, one or more additional polymers, different average lengths, or otherwise distinguishable constructions), where one group offers a certain advantage(s) in one aspect, and other group a certain advantage(s) in another aspect.

Fibers described herein can generally be made using techniques known in the art for making multi-component (e.g., bi-component) fibers. Such techniques include fiber spinning (see, e.g., U.S. Pat. No. 4,406,850 (Hills), U.S. Pat. No. 5,458,972 (Hagen), U.S. Pat. No. 5,411,693 (Wust), U.S. Pat. No. 5,618,479 (Lijten), and U.S. Pat. No. 5,989,004 (Cook)).

Each component of the fibers, including the first polymeric composition, second polymeric composition, and any additional polymers, can be selected to provide desirable performance characteristics.

In some embodiments, the first polymeric composition in the multi-component fibers has a softening temperature of at least 150° C. (in some embodiments, up to 140° C., 130° C., 120° C., 110° C., 100° C., 90° C., 80° C., or 70° C. or in a range from 80° C. to 150° C.). The softening temperature of the first polymeric composition is determined using a stress-controlled rheometer (Model AR2000 manufactured by TA Instruments, New Castle, Del.) according to the following procedure. A sample of the first polymeric composition is placed between two 20 mm parallel plates of the rheometer and pressed to a gap of 2 mm ensuring complete coverage of the plates. A sinusoidal frequency of 1 Hz at 1% strain is then applied over a temperature range of 80° C. to 200° C. The resistance force of the molten resin to the sinusoidal strain is proportional to its modulus which is recorded by a transducer and displayed in graphical format. Using rheometeric software, the modulus is mathematically split into two parts: one part that is in phase with the applied strain (elastic modulus—solid-like behavior), and another part that is out of phase with the applied strain (viscous modulus—liquid-like behavior). The temperature at which the two moduli are identical (cross-over temperature) is the softening temperature, as it represents the temperature above which the resin began to behave predominantly like a liquid.

For any of the embodiments of multi-component fibers disclosed herein, the first polymeric composition may be a single polymeric material, a blend of polymeric materials, or a blend of at least one polymer and at least one other additive. The softening temperature of the first polymeric composition, advantageously, may be above the storage temperature of the multi-component fiber. The desired softening temperature can be achieved by selecting an appropriate single polymeric material or combining two or more polymeric materials. For example, if a polymeric material softens at too high of a temperature it can be decreased by adding a second polymeric material with a lower softening temperature. Also, a polymeric material may be combined with, for example, a plasticizer to achieve the desired softening temperature.

Exemplary polymers that have or may be modified to have a softening temperature up to 150° C. (in some embodiments, up to than 140° C., 130° C., 120° C., 110° C., 100° C., 90° C., 80° C., or 70° C. or in a range from 80° C. to 150° C.) include at least one of (i.e., includes one or more of the following in any combination) ethylene-vinyl alcohol copolymer (e.g., with softening temperature of 156 to 191° C., available from EVAL America, Houston, Tex., under the trade designation "EVAL G176B"), thermoplastic polyurethane (e.g., available from Huntsman, Houston, Tex., under the trade designation "IROGRAN A80 P4699"), polyoxymethylene (e.g., available from Ticona, Florence, Ky., under the trade designation "CELCON FG40U01"), polypropylene (e.g., available from Total, Paris, France, under the trade designation "5571"), polyolefins (e.g., available from ExxonMobil, Houston, Tex., under the trade designation "EXACT 8230"), ethylene-vinyl acetate copolymer (e.g., available from AT Plastics, Edmonton, Alberta, Canada), polyester (e.g., available from Evonik, Parsippany, N.J., under the trade designation "DYNAPOL" or from EMS-Chemie AG, Reichenauerstrasse, Switzerland, under the trade designation "GRILTEX"), polyamides (e.g., available from Arizona Chemical, Jacksonville, Fla., under the trade designation "UNIREZ 2662" or from E.I. du Pont de Nemours, Wilmington, Del., under the trade designation "ELVAMIDE 8660"), phenoxy (e.g., from Inchem, Rock Hill S.C.), vinyls (e.g., polyvinyl chloride form Omnia Plastica, Arsizio, Italy), or acrylics (e.g., from Arkema, Paris, France, under the trade designation "LOTADEREX 8900"). In some embodiments, the first polymeric composition comprises a partially neutralized ethylene-methacrylic acid copolymer commercially available, for example, from E.I. duPont de Nemours & Company, under the trade designations "SURLYN 8660," "SURLYN 1702," "SURLYN 1857," and "SURLYN 9520"). In some embodiments, the first polymeric composition comprises a mixture of a thermoplastic polyurethane obtained from Huntsman under the trade designation "IROGRAN A80 P4699", a polyoxymethylene obtained from Ticona under the trade designation "CELCON FG40U01", and a polyolefin obtained from ExxonMobil Chemical under the trade designation "EXACT 8230". In some embodiments, multi-component fibers useful for the articles according to the present disclosure may comprise in a range from 5 to 85 (in some embodiments, 5 to 40, 40 to 70, or 60 to 70) percent by weight of the first polymeric composition.

In some embodiments of articles and methods according to the present disclosure, the first polymeric composition has an elastic modulus of less than $3\times10^5$ N/m$^2$ at a frequency of about 1 Hz at a temperature of at least 80° C. In these embodiments, typically the first polymeric composition is tacky at the temperature of 80° C. and above. In some embodiments, the first polymeric composition has an elastic modulus of less than $3\times10^5$ N/m$^2$ at a frequency of about 1 Hz at a temperature of at least 85° C., 90° C., 95° C., or 100° C. For any of these embodiments, the modulus is measured using the method described above for determining softening temperature except the modulus is determined at the selected temperature (e.g., 80° C., 85° C., 90° C., 95° C., or 100° C.).

In some embodiments of multi-component fibers useful for the articles and methods disclosed herein, the second polymeric composition has a melting point of at least 130° C. (in some embodiments, at least 140° C. or 150° C.; in some embodiments, in a range from 130° C. to 220° C., 150° C. to 220° C., 160° C. to 220° C.). Exemplary useful second polymeric compositions include at least one of (i.e., includes one or more of the following in any combination) an ethylene-vinyl alcohol copolymer (e.g., available from EVAL America, under the trade designation "EVAL G176B"), polyamide (e.g., available from E.I. du Pont de Nemours under the trade designation "ELVAMIDE" or from BASF North America, Florham Park, N.J., under the trade designation "ULTRAMID"), polyoxymethylene (e.g., available from Ticona under the trade designation "CELCON"), polypropylene (e.g., from Total), polyester (e.g., available from Evonik under the trade designation "DYNAPOL" or from EMS-Chemie AG under the trade designation "GRILTEX"), polyurethane (e.g., available from Huntsman under the trade designation "IROGRAN"), polysulfone, polyimide, polyetheretherketone, or polycarbonate. As described above for the first polymeric compositions, blends of polymers and/or other components can be used to make the second polymeric compositions. For example, a thermoplastic having a melting point of less than 130° C. can be modified by adding a higher-melting thermoplastic polymer. In some embodiments, the second polymeric composition is present in a range from 5 to 40 percent by weight, based on the total weight of the multi-component fiber. The melting temperature is measured by differential scanning calorimetry (DSC). In cases where the second polymeric composition includes more than one polymer, there may be two melting points. In these cases, the melting point of at least 130° C. is the lowest melting point in the second polymeric composition.

Optionally, fibers described herein may further comprise other components (e.g., additives and/or coatings) to impart desirable properties such as handling, processability, stability, and dispersability. Exemplary additives and coating materials include antioxidants, colorants (e.g., dyes and pigments), fillers (e.g., carbon black, clays, and silica), and surface applied materials (e.g., waxes, surfactants, polymeric dispersing agents, talcs, erucamide, gums, and flow control agents) to improve handling.

Surfactants can be used to improve the dispersibility or handling of multi-component fibers described herein. Useful surfactants (also known as emulsifiers) include anionic, cationic, amphoteric, and nonionic surfactants. Useful anionic surfactants include alkylarylether sulfates and sulfonates, alkylarylpolyether sulfates and sulfonates (e.g., alkylarylpoly(ethylene oxide) sulfates and sulfonates, preferably those having up to about 4 ethyleneoxy repeat units, including sodium alkylaryl polyether sulfonates such as those known under the trade designation "TRITON X200", available from Rohm and Haas, Philadelphia, Pa.), alkyl sulfates and sulfonates (e.g., sodium lauryl sulfate, ammonium lauryl sulfate, triethanolamine lauryl sulfate, and sodium hexadecyl sulfate), alkylaryl sulfates and sulfonates (e.g., sodium dodecylbenzene sulfate and sodium dodecylbenzene sulfonate), alkyl ether sulfates and sulfonates (e.g., ammonium lauryl ether sulfate), and alkylpolyether sulfate and sulfonates (e.g., alkyl poly(ethylene oxide) sulfates and sulfonates, preferably those having up to about 4 ethyleneoxy units). Useful nonionic surfactants include ethoxylated oleoyl alcohol and polyoxyethylene octylphenyl ether. Useful cationic surfactants include mixtures of alkyl dimethylbenzyl ammonium chlorides, wherein the alkyl chain has from 10 to 18 carbon atoms. Amphoteric surfactants are also useful and include sulfobetaines, N-alkylaminopropionic acids, and N-alkylbetaines. Surfactants may be added to the fibers disclosed herein, for example, in an amount sufficient on average to make a monolayer coating over the surfaces of the fibers to induce spontaneous wetting. Useful amounts of surfactants may be in a range, for example, from 0.05 to 3 percent by weight, based on the total weight of the multi-component fiber.

Polymeric dispersing agents may also be used, for example, to promote the dispersion of fibers described herein in a chosen medium, and at the desired application conditions (e.g., pH and temperature). Exemplary polymeric dispersing agents include salts (e.g., ammonium, sodium, lithium, and potassium) of polyacrylic acids of greater than 5000 average molecular weight, carboxy modified polyacrylamides (available, for example, under the trade designation "CYANAMER A-370" from Cytec Industries, West Paterson, N.J.), copolymers of acrylic acid and dimethylaminoethylmethacrylate, polymeric quaternary amines (e.g., a quaternized polyvinyl-pyrollidone copolymer (available, for example, under the trade designation "GAFQUAT 755" from ISP Corp., Wayne, N.J.) and a quaternized amine substituted cellulosic (available, for example, under the trade designation "JR-400" from Dow Chemical Company, Midland, Mich.), cellulosics, carboxy-modified cellulosics (e.g., sodium carboxy methycellulose (available, for example, under the trade designation "NATROSOL CMC Type 7L" from Hercules, Wilmington, Del.), and polyvinyl alcohols. Polymeric dispersing agents may be added to the fibers disclosed herein, for example, in an amount sufficient on average to make a monolayer coating over the surfaces of the fibers to induce spontaneous wetting. Useful amounts of polymeric dispersing agents may be in a range, for example, from 0.05 to 5 percent by weight, based on the total weight of the fiber.

Examples of antioxidants that may be useful in the multi-component fibers include hindered phenols (available, for example, under the trade designation "IRGANOX" from Ciba Specialty Chemical, Basel, Switzerland). Typically, antioxidants are used in a range from 0.1 to 1.5 percent by weight, based on the total weight of the fiber, to retain useful properties during extrusion and through the life of the article.

In some embodiments of the fibers useful for practicing the present disclosure, the fibers may be crosslinked, for example, through radiation or chemical means. Chemical crosslinking can be carried out, for example, by incorporation of thermal free radical initiators, photoinitiators, or ionic crosslinkers. When exposed to a suitable wavelength of light, for example, a photoinitiator can generate free radicals that cause crosslinking of polymer chains. With radiation crosslinking, initiators and other chemical crosslinking agents may not be necessary. Suitable types of radiation include any radiation that can cause crosslinking of polymer chains such as actinic and particle radiation (e.g., ultraviolet light, X rays, gamma radiation, ion beam, electronic beam, or other high-energy electromagnetic radiation). Crosslinking may be carried out to a level at which, for example, an increase in modulus of the first polymeric composition is observed.

In this application, the term ceramic in the hollow ceramic microspheres refers to glasses, crystalline ceramics, glass-ceramics, and combinations thereof. In some embodiments, the hollow ceramic microspheres useful for practicing the present disclosure are glass microbubbles. Glass microbubbles are known in the art and can be obtained commercially and/or be made by techniques known in the art (see, e.g., U.S. Pat. No. 2,978,340 (Veatch et al.); U.S. Pat. No. 3,030,215 (Veatch et al.); U.S. Pat. No. 3,129,086 (Veatch et al.); and U.S. Pat. No. 3,230,064 (Veatch et al.); U.S. Pat. No. 3,365,315 (Beck et al.); U.S. Pat. No. 4,391,646 (Howell); and U.S. Pat. No. 4,767,726 (Marshall); and U.S. Pat. App. Pub. No. 2006/0122049 (Marshall et. al), which are incorporated herein by reference for their disclosure of silicate glass compositions and methods of making glass microbubbles). Glass microbubbles may have, for example, a chemical composition wherein at least 90%, 94%, or even 97% of the glass consists essentially of at least 67% $SiO_2$, (e.g., a range of 70% to 80% $SiO_2$), a range of 8% to 15% CaO, a range of 3% to 8% $Na_2O$, a range of 2% to 6% $B_2O_3$, and a range of 0.125% to 1.5% $SO_3$.

When preparing glass microbubbles according to methods known in the art (e.g., by crushing frit and heating the resulting particles to form microbubbles), the amount of sulfur in the glass particles (i.e., feed) and the amount and length of heating to which the particles are exposed (e.g., the rate at which particles are fed through a flame) can typically be adjusted to provide glass microbubbles of a selected density. Lower amounts of sulfur in the feed and faster heating rates lead to higher density bubbles as described in U.S. Pat. No. 4,391,646 (Howell) and U.S. Pat. No. 4,767,726 (Marshall).

Useful glass microbubbles include those marketed by 3M Company under the trade designation "3M GLASS BUBBLES" (e.g., grades K1, K15, S15, S22, K20, K25, S32, K37, S38, S38HS, S38XHS, K46, A16/500, A20/1000, D32/4500, H50/10000, S60, S60HS, and iM30K); glass bubbles marketed by Potters Industries, Valley Forge, Pa., (an affiliate of PQ Corporation) under the trade designations "Q-CEL HOLLOW SPHERES" (e.g., grades 30, 6014, 6019, 6028, 6036, 6042, 6048, 5019, 5023, and 5028) and "SPHERICEL HOLLOW GLASS SPHERES" (e.g., grades 110P8 and 60P18); and hollow glass particles marketed by Silbrico Corp., Hodgkins, Ill. under the trade designation "SIL-CELL" (e.g., grades SIL 35/34, SIL-32, SIL-42, and SIL-43).

In some embodiments, the hollow ceramic microspheres are aluminosilicate microspheres extracted from pulverized fuel ash collected from coal-fired power stations (i.e., cenospheres). Useful cenospheres include those marketed by Sphere One, Inc., Chattanooga, Tenn., under the trade designation "EXTENDOSPHERES HOLLOW SPHERES" (e.g., grades XOL-200, XOL-150, SG, MG, CG, TG, HA, SLG, SL-150, 300/600, 350 and FM-1); and those marketed by 3M Company under the trade designation "3M HOLLOW CERAMIC MICROSPHERES" (e.g., grades G-3125, G-3150, and G-3500).

In some embodiments, the hollow ceramic microspheres are perlite microspheres. Perlite is an amorphous volcanic glass that greatly expands and forms microspheres when it is sufficiently heated. The bulk density of perlite microspheres is typically in a range, for example, from 0.03 to 0.15 $g/cm^3$. A typical composition of perlite microspheres is 70% to 75% $SiO_2$, 12% to 15% $Al_2O_3$, 0.5% to 1.5% CaO, 3% to 4% $Na_2O$, 3% to 5% $K_2O$, 0.5% to 2% $Fe_2O_3$, and 0.2% to 0.7% MgO. Useful perlite microspheres include those available, for example, from Silbrico Corporation, Hodgkins, Ill.

In some embodiments, the hollow ceramic microspheres (e.g., glass microbubbles) have an average true density in a range from 0.1 $g/cm^3$ to 1.2 $g/cm^3$, from 0.1 $g/cm^3$ to 1.0 $g/cm^3$, from 0.1 $g/cm^3$ to 0.8 $g/cm^3$, from 0.1 $g/cm^3$ to 0.5 $g/cm^3$, or, in some embodiments, 0.3 $g/cm^3$ to 0.5 $g/cm^3$. For some applications, the hollow ceramic microspheres utilized in articles according to the present disclosure may be selected based on their density to lower the thermal conductivity of the article as much as possible, which is useful, for example, for thermal insulation. Accordingly, in some embodiments, the hollow ceramic microspheres have an average true density of up to or less than 0.5 grams per cubic centimeter. The term "average true density" is the quotient obtained by dividing the mass of a sample of glass bubbles by the true volume of that mass of glass bubbles as measured by a gas pycnometer. The "true volume" is the aggregate total volume of the glass bubbles, not the bulk volume. For the purposes of this disclosure, average true density is measured using a pycnometer according to ASTM D2840-69, "Average True Particle Density of Hollow Microspheres". The pycnometer may be obtained, for example, under the trade designation "Accupyc 1330 Pycnometer" from Micromeritics, Norcross, Ga. Average true density can typically be measured with an accuracy of 0.001 g/cc. Accordingly, each of the density values provided above can be ±one percent.

The mean particle size of the hollow ceramic microspheres may be, for example, in a range from 5 to 250 micrometers (in some embodiments from 5 to 150 micrometers, from 10 to 120 micrometers, or from 20 to 100 micrometers). The hollow ceramic microspheres may have a multimodal (e.g., bimodal or trimodal) size distribution (e.g., to improve packing efficiency) as described, for example, in U.S. Pat. Appl. Publ. No. 2002/0106501 A 1 (Debe). As used herein, the term size is considered to be equivalent with the diameter and height of the glass bubbles. For the purposes of the present disclosure, the median size by volume is determined by laser light diffraction by dispersing the glass bubbles in deaerated deionized water. Laser light diffraction particle size analyzers are available, for example, under the trade designation "SATURN DIGISIZER" from Micromeritics.

The ratio of hollow ceramic microspheres to multi-component fibers useful for articles and methods of the present disclosure depends, for example, on the application, the crossover point density in the fibers, and the particle size distribution of the hollow ceramic microspheres. In some applications such insulation and acoustic damping, it is useful to maximize the amount of hollow ceramic microspheres so that the properties of the article are very similar to the hollow ceramic microspheres themselves. In some embodiments, the maximum amount of hollow ceramic microspheres useful in the articles disclosed herein is the closest packing density of the hollow ceramic microspheres. In some embodiments, the volume of hollow ceramic microspheres in the articles or mixtures of hollow ceramic microspheres and multi-component fibers disclosed herein is at least 50, 60, 70, 80, or 90 percent, based on the total volume in the article or the mixture. In some embodiments, the hollow ceramic microspheres are present at a level of at least 95 percent by volume, based on the total volume of the article or mixture. In some embodiments, the weight of hollow ceramic microspheres in the articles or mixtures of hollow ceramic microspheres and multi-component fibers disclosed herein is at least 50, 60, 70, 80, or 85 percent, based on the total weight in the article or mixture. In some embodiments, the hollow ceramic microspheres are present at a level of at least 90 percent by weight, based on the total weight of the article or mixture. In some embodiments, the remaining weight or volume percent in the articles and mixtures mentioned above is made up by the multi-component fibers. That is, articles comprising only the hollow ceramic microspheres and the multi-component fibers are useful.

In some embodiments, the article according to and/or prepared according to the present disclosure further comprises an adhesion promoter, which may be useful for example, for enhancing the adhesion between the hollow ceramic microspheres and the multi-component fibers. Useful adhesion promoters include silanes, titanates, and zirconates, which may have a functional group that is reactive with, for example, the first polymeric composition of the multi-component fibers. In these embodiments, the hollow ceramic microspheres may be surface-treated microspheres, for example, wherein the surface-treatment is a silane, titanate, or zirconate treatment. In some embodiments, the adhesion promoter is a silane. Useful silanes include vinyltrimethoxysilane, (3-glycidyloxypropyl)trimethoxysilane, (3-aminopropyl)triethoxysilane, (3-aminopropyl)trimethoxysilane, 3-(triethoxysilyl)propyl methacrylate, and 3-(trimethoxysilyl)propyl methacrylate. The amount of adhesion promoter may be up to 5, 4, 3, 2, or 1 percent by weight and at least 0.1, 0.2, 0.5, or 0.75 percent by weight, based on the total weight of the article or mixture. The amount of adhesion promoter may be up to 1, 0.75, or 0.5 percent by volume and at least 0.01, 0.02, 0.05, or 0.075 percent by volume, based on the total volume of the article or mixture.

Typically, articles according to the present disclosure do not comprise a continuous polymer matrix, for example, in which a plurality of the multi-component fibers and hollow ceramic microspheres are dispersed. Likewise, a mixture of multi-component fibers and hollow ceramic microspheres in the method disclosed herein typically does not include the fibers and microspheres dispersed in a continuous matrix. In some embodiments, it is useful for the articles disclosed herein and the mixtures in the methods of making the articles to include a polymer that is not included in the multi-component fiber. The polymer may be useful in some embodiments, for example, for holding the packs of fibers and hollow ceramic microspheres together. Depending on the application, the polymer may be a thermoplastic or thermoset material. Both flexible and rigid polymers may be useful. Useful polymers include epoxies, acrylics (including methacrylics), polyurethanes (including polyureas), phenolics, silicones, polyesters, and polyethylene-vinyl acetates. The amount of polymer may be up to 20, 15, or 10 percent by weight and at least 1, 2, or 5 percent by weight, based on the total weight of the article or mixture. The amount of polymer may be up to 7.5, 5, or 2.5 percent by volume and at least 0.1, 0.2, 0.5, or 1 percent by volume, based on the total volume of the article or mixture.

In some embodiments, articles or mixtures of the present disclosure include other fibers, different from the multi-component fibers. Other fibers can be used to impart desirable properties to the final article. For example, cellulose, ceramic, or glass fibers can be used in the article to alter the rigidity of the article, further reduce organic content of the article, increase the flame resistance, and/or lower the cost.

Articles according to the present disclosure may be useful, for example, for insulating various articles. For example, articles according to the present disclosure may be useful for insulating pipes, production trees, manifolds, and jumpers, which can be located, for example, in underwater environments (e.g., submerged in the ocean). Articles may also be useful for pipe insulation above ground, insulation mats for tanker trucks (e.g., for cryogenic liquid transportation), cold storage, or automotive thermal battery packs. Articles according to the present disclosure may also be useful for acoustical insulation for automotive applications, railroad passenger cars, architectural applications, or for personal protection. Articles according to the present disclosure may also be useful for acoustical insulation for certain appliances, such as refrigirators, electric or solar cookware, or water heaters.

It should be understood that the article disclosed herein, in any of the various embodiments described above and below, is not located in or bonded to a fracture in a subterranean formation such as a hydrocarbon (e.g., oil or gas) bearing geological formation. Similarly, in the method disclosed herein in any of its various embodiments, heating the mixture to a temperature at which the multi-component fibers are non-fusing and at which the first polymeric composition has an elastic modulus of less than $3\times10^5$ N/m$^2$ at a temperature of at least 80° C. measured at a frequency of one hertz does not include injecting the mixture of microspheres and multi-component fibers into a subterranean formation such as a hydrocarbon (e.g., oil or gas) bearing geological formation or into a fracture in such a formation.

Articles according to the present disclosure provide advantages over syntactic foams that are typically used for insulation. For example, in syntactic foams, as the amount of the matrix material is reduced, the foam becomes increasingly fragile and brittle. Hollow microsphere packs that are joined by a discontinuous coating of resin may be very brittle. In contrast, as disclosed in some embodiments herein, hollow ceramic microspheres at very high levels (e.g., greater than 90 percent by volume) can be joined together with the multi-component fibers to form a relatively flexible article. The density of the article may be essentially the same as the bulk density of the hollow microspheres, and other properties such as thermal conductivity and acoustic damping may be dominated by the hollow microspheres. The low organic content that can be achieved with some embodiments of the article renders the resulting article highly flame resistant.

The method according to the present disclosure includes providing a mixture of hollow ceramic microspheres and multi-component fibers. Mixing can be carried out by techniques involving mechanical and/or electrostatic mixing. Solvents and/or water can optionally be included to assist in uniformly mixing the microspheres and the fibers. In some embodiments, the fibers and microspheres are mixed in a conventional way-lay process. In some embodiments, however, the mixing of the hollow ceramic microspheres and the multi-component fibers is a solventless process, which may be advantageous because no heating is necessary to evaporate residual water or solvents, which can eliminate process steps and reduce cost. Mixing can be carried out, for example, via convective mixing, diffusive mixing, and shear mixing mechanisms. For example, mixing the microspheres with the multi-component fibers can be carried out using conventional tumbling mixers (e.g., V-blender, double cone, or rotating cube); convective mixers (e.g., ribbon blender, nautamixer); fluidized bed mixers; or high-shear mixers. In some embodiments, the hollow ceramic microspheres and multi-component fibers are tumbled together in a suitable container. In other embodiments, the multi-component fibers may first be formed into a web, for example, by air-laying and thermally bonding, and the resulting web may be shaken together with the hollow ceramic microspheres. In still other embodiments, the mixing the multi-component fibers and the hollow ceramic microspheres can be carried out by hand, for example, in water. The multi-component fibers may be in bundles when they are formed, and suitable methods such as wet-laying, air-laying, and subjecting the fibers to a grinder may be useful for separating the fibers and exposing their surfaces.

For methods according to the present disclosure, a mixture of the multi-component fibers and hollow ceramic microspheres are heated to a temperature at which the multi-component fibers are non-fusing and at which the first polymeric composition has an elastic modulus of less than $3\times10^5$ N/m$^2$ at a temperature of at least 80° C. measured at a frequency of one hertz. The first polymeric composition becomes tacky at this temperature and adheres the multi-component fibers to one another and adheres the hollow ceramic microspheres to the fibers. Adhesion promoters or other polymers as described above may be added to the mixture. In some embodiments, the mixture is placed in a mold before it is heated. Pressure may be applied to the mold, if desired, to consolidate the pack of hollow ceramic microspheres and multi-component fibers. Heating may be carried out in a conventional oven or using microwave, infrared, or radio frequency heating. In some embodiments, the mixture is positioned adjacent to (e.g., in contact with) an article to be insulated before it is heated. In other embodiments, the article can be formed as a mat or sheet to later place adjacent to an article to be insulated.

Some Embodiments of the Disclosure

In a first embodiment, the present disclosure provides an article comprising:

multi-component fibers having external surfaces and comprising at least a first polymeric composition and a second polymeric composition, wherein at least a portion of the external surfaces of the multi-component fibers comprises the first polymeric composition, and wherein the multi-component fibers are adhered together; and hollow ceramic microspheres adhered at least to the first polymeric composition on the external surfaces of at least some of the multi-component fibers.

In a second embodiment, the present disclosure provides the article of the first embodiment, wherein the article does not comprise a continuous polymer matrix.

In a third embodiment, the present disclosure provides the article of the first or second embodiment, wherein the hollow ceramic microspheres are directly attached to the external surfaces of the multi-component fibers.

In a fourth embodiment, the present disclosure provides the article of any one of the first to third embodiments, wherein the hollow ceramic microspheres have an average true density of less than 0.5 grams per cubic centimeter.

In a fifth embodiment, the present disclosure provides the article of any one of the first to fourth embodiments, wherein the first polymeric composition has a softening temperature of up to 150° C., wherein the second polymeric composition has a melting point of at least 130° C., and wherein the difference between the softening temperature of the first polymeric composition and the melting point of the second polymeric composition is at least 10° C.

In a sixth embodiment, the present disclosure provides the article of any one of the first to fifth embodiments, wherein the first polymeric composition has an elastic modulus of less than $3\times10^5$ N/m$^2$ at a temperature of at least 80° C. measured at a frequency of one hertz.

In a seventh embodiment, the present disclosure provides the article of any one of the first to sixth embodiments, wherein the first polymeric composition is at least one of ethylene-vinyl alcohol copolymer, at least partially neutralized ethylene-methacrylic acid or ethylene-acrylic acid copolymer, polyurethane, polyoxymethylene, polypropylene, polyolefin, ethylene-vinyl acetate copolymer, polyester, polyamide, phenoxy, vinyl, or acrylic.

In an eighth embodiment, the present disclosure provides the article of any one of the first to seventh embodiments, wherein the second polymeric composition is at least one of an ethylene-vinyl alcohol copolymer, polyamide, polyoxymethylene, polypropylene, polyester, polyurethane, polysulfone, polyimide, polyetheretherketone, or polycarbonate.

In a ninth embodiment, the present disclosure provides the article of any one of the first to eighth embodiments, wherein the multi-component fibers are non-fusing at a temperature of at least 110° C.

In a tenth embodiment, the present disclosure provides the article of any one of the first to ninth embodiments, wherein the multi-component fibers are in a range from 3 millimeters to 60 millimeters in length.

In an eleventh embodiment, the present disclosure provides the article of any one of the first to tenth embodiments, wherein the multi-component fibers are in a range from 10 to 100 micrometers in diameter.

In a twelfth embodiment, the present disclosure provides the article of any one of the first to eleventh embodiments, wherein the hollow ceramic microspheres are present at a level of at least 95 percent by volume, based on the total volume of the article.

In a thirteenth embodiment, the present disclosure provides the article of any one of the first to twelfth embodiments, wherein the hollow ceramic microspheres are glass microbubbles or perlite microspheres.

In a fourteenth embodiment, the present disclosure provides the article of any one of the first to thirteenth embodiments having a density of up to 0.5 grams per cubic centimeter.

In a fifteenth embodiment, the present disclosure provides the article of any one of the first to fourteenth embodiments, further comprising an adhesion promoter.

In a sixteenth embodiment, the present disclosure provides the article of any one of the first to fifteenth embodiments, further comprising up to 5 percent by volume of a polymer not included in the multi-component fiber.

In a seventeenth embodiment, the present disclosure provides the article of any one of the first to sixteenth embodiments, further comprising other, different fibers.

In an eighteenth embodiment, the present disclosure provides use of the article of any one of the first to seventeenth embodiments for at least one of thermal insulation, acoustic insulation, or electrical insulation.

In a nineteenth embodiment, the present disclosure provides a method of making an article, which may be a method of making insulation, the method comprising:

providing a mixture of hollow ceramic microspheres and multi-component fibers, the multi-component fibers comprising at least a first polymeric composition and a second polymeric composition; and heating the mixture to a temperature at which the multi-component fibers are non-fusing and at which the first polymeric composition has an elastic modulus of less than $3\times10^5$ N/m$^2$ at a temperature of at least 80° C. measured at a frequency of one hertz.

In a twentieth embodiment, the present disclosure provides the method of the nineteenth embodiment, wherein the first polymeric composition has a softening temperature of up to 150° C., wherein the second polymeric composition has a melting point of at least 130° C., and wherein the difference between the softening temperature of the first polymeric composition and the melting point of the second polymeric composition is at least 10° C.

In a twenty-first embodiment, the present disclosure provides the method of the nineteenth or twentieth embodiment, wherein the multi-component fibers are in a range from 3 millimeters to 60 millimeters in length and in a range from 10 to 100 micrometers in diameter.

In a twenty-second embodiment, the present disclosure provides the method of any one of the nineteenth to twenty-first embodiments, wherein the hollow ceramic microspheres are present at a level of at least 90 percent by weight, based on the total weight of the mixture.

In a twenty-third embodiment, the present disclosure provides the method of any one of the nineteenth to twenty-second embodiments, wherein the hollow ceramic microspheres are glass microbubbles or perlite microspheres.

In a twenty-fourth embodiment, the present disclosure provides the method of any one of the nineteenth to twenty-third embodiments, wherein the mixture further comprises an adhesion promoter.

In a twenty-fifth embodiment, the present disclosure provides the method of any one of the nineteenth to twenty-fourth embodiments, wherein the mixture further comprises up to 20 percent by weight of a polymer not included in the multi-component fiber.

In a twenty-sixth embodiment, the present disclosure provides the method of any one of the nineteenth to twenty-fifth embodiments, wherein before the heating, the mixture is positioned in contact with an article to be insulated.

In a twenty-seventh embodiment, the present disclosure provides the method of any one of the nineteenth to twenty-sixth embodiments, wherein the mixture further comprises other, different fibers.

In order that this disclosure can be more fully understood, the following examples are set forth.

The particular materials and amounts thereof recited in these examples, as well as other conditions and details, should not be construed to unduly limit this disclosure.

EXAMPLES

In these examples, all percentages, proportions and ratios are by weight unless otherwise indicated. These abbreviations are used in the following examples: g=gram, min=minutes, in=inch, m=meter, cm=centimeter, mm=millimeter, and ml=milliliter, Test Methods Acoustic Transmission Loss Acoustic transmission loss test was carried out according to test method ASTM E2611-09, "Standard Test Method for Measurement of Normal Incidence Sound Transmission of Acoustical Materials Based on the Transfer Matrix Method". An impedance tube kit type "4206-T" was obtained from Brüel & Kjaer, Norcross, Ga.

Thermal Conductivity

Thermal conductivity of articles comprising multi-component fibers and hollow microspheres (composite) was measured using a thermal conductivity measurement instrument (model "F200", obtained from LaserComp Inc., Saugus, Mass.). The mean temperature was set to 10, 20, 30, 40, 50 or 60° C., and heat flow was measured when the sample had reached the set temperature.

Vertical and Horizontal Burn Tests

A vertical burn test was conducted according to the procedure outlined in the Flammability Requirement test "FAR 25.853 (a) (1) (i)", wherein the sample is submitted to a 60 second vertical burner. A horizontal burn test was conducted according to the procedure outlined in the Flammability Requirement test FAR 25.856 (a).

Materials

| TRADE DESIGNATION | DESCRIPTION | SUPPLIER |
|---|---|---|
| N/A | n-Butyl acrylate | BASF North America, Florham Park, NJ |
| N/A | Ethyl acrylate | BASF |
| "RHODACAL DS-10" | Sodium dodecyl benzene sulfonate | Rhodia, Cranberry, NJ |
| "T-DET N-10.5" | Nonyl phenol polyethylene oxide | Harcros Chemicals, Kansas City, KS |

-continued

| TRADE DESIGNATION | DESCRIPTION | SUPPLIER |
|---|---|---|
| N/A | Acrylic acid | Dow Chemical, Midland, MI |
| N/A | Potassium persulfate | Sigma-Aldrich, Milwaukee, WI |
| N/A | Sodium meta-bisulfite | Sigma-Aldrich |
| "ULTRAMID B24" | Polyamide 6 | BASF |
| "AMPLIFY IO 3702" | Ethylene acrylic acid ionomer | Dow Chemical |
| "3M GLASS BUBBLES" "K15" and "K1" | Glass bubbles | 3M Company, St. Paul, MN |
| "ARALDITE PZ-323" | Epoxy resin dispersion | Huntsman, The Woodlands, TX |
| "Z-6137" | Aminoethylaminopropyl-silane triol homopolymer $H_2NC_2H_4NHC_3H_6$—$Si(OH)_3$ in water | Dow Corning, Midland, MI |
| "ISOFRAX" | Ceramic fibers | Thermal Ceramics, Augusta, GA |
| "AIRFLEX 600BP" | Polymeric dispersion of copolymers of vinylacetate, acrylic acid ester and ethylene in water | Air Products and Chemicals, Allentown, PA |
| "FOAMMASTER 111" | Defoamer | Henkel, Edison, NJ |
| "MP 9307C" | Flocculant | Mid South Chemical, Ringgold, LA |

Preparation of Acrylic Emulsion:

An acrylic emulsion was prepared according to the following description: an ethyl acrylate/n-butyl acrylate/acrylic acid (66/26/8) terpolymer was made via emulsion polymerization. In a two liter reaction vessel equipped with variable speed agitation, nitrogen inlet and outlet, and a water-cooled condenser, 600 g of distilled water, 4.8 g of "RHODACAL DS-10" sodium dodecyl benzene sulfonate, and 4.8 g "T-DET N-10.5" nonyl phenol polyethylene oxide were added. The composition was mixed until solids dissolved. A mixture comprising 264 g of ethyl acrylate, 104 g of n-butyl acrylate and 32 g of acrylic acid was then added to the reactor with agitation speed set at 350 rpm. Nitrogen purge was started, and the vessel was heated to 32° C. With the temperature at 32° C., 0.30 g of potassium persulfate and 0.08 g of sodium meta-bisulfite were added to the vessel. An exothermic reaction started. After the temperature peaked, the solution was allowed to cool to room temperature.

Example 1

Articles comprising multi-component fibers and hollow microspheres composites were prepared as described below.

Multi-component fibers were prepared as generally described in Example 1 of U.S. Pat. No. 4,406,850 (Hills), incorporated herein by reference, except (a) the die was heated to the temperature listed in Table 1, below; (b) the extrusion die had sixteen orifices laid out as two rows of eight holes, wherein the distance between holes was 12.7 mm (0.50 inch) with square pitch, and the die had a transverse length of 152.4 mm (6.0 inches); (c) the hole diameter was 1.02 mm (0.040 inch) and the length to diameter ratio was 4.0; (d) the relative extrusion rates in grams per hole per minute of the two streams are reported in Table 1; (e) the fibers were conveyed downwards a distance reported in Table 1 and air quenched by compressed air and wound on a core; and (f) the spinning speed was adjusted by a pull roll to rates reported in Table 1.

TABLE 1

| Multi-component Fiber | Core Rate, grams per hole per minute | Sheath Rate, grams per hole per minute | Die Temperature, ° C. | Pull Roll Speed, Meters/minute | Distance to Quench, centimeters |
|---|---|---|---|---|---|
| Fiber 1 | 0.25 | 0.24 | 220 | 950 | 36 |

The core material (second polymeric composition) for the multi-component fibers of Example 1 was "ULTRAMID B24" polyamide. The sheath material (first polymeric composition) was "AMPLIFY IO 3702" ethylene-acrylic acid ionomer. The multi-component fibers had a fiber density of about 1.02 g/mL, an average diameter of about 20 micrometers and were chopped to a length of about 6 mm. The softening temperature of "AMPLIFY IO 3702" ethylene acrylic acid ionomer was found to be 110° C. when evaluated using the method described in the Detailed Description (page 6, lines 24 to 35). That is, the crossover temperature was 110° C. Also using this method except using a frequency of 1.59 Hz, the elastic modulus was found to be $8.6\times10^4$ N/m$^2$ at 100° C., $6.1\times10^4$ N/m$^2$ at 110° C., $4.3\times10^4$ N/m$^2$ at 120° C., $2.8\times10^4$ N/m$^2$ at 130° C., $1.9\times10^4$ N/m$^2$ at 140° C., $1.2\times10^4$ N/m$^2$ at 150° C., and $7.6\times10^3$ N/m$^2$ at 160° C. The melting point of "AMPLIFY IO 3702" ethylene acrylic acid ionomer is reported to be 92.2° C. by Dow Chemical in a data sheet dated 2011. The melting point of "ULTRAMID B24" polyamide 6 is reported to be 220° C. by BASF in a product data sheet dated September 2008. The grade of the "ULTRAMID B24" polyamide 6 did not contain titanium dioxide. A fiber having the same sheath except obtained under trade designation "SURYLYN 1702" from E.I. duPont de Nemours & Company, Wilmington, Del., which is reported in a product data sheet dated 2010 to have a melting point of 93° C. and the same melt flow rate as "AMPLIFY IO 3702" ethylene acrylic acid ionomer, and a core made from "ZYTEL RESIN 101NC010" from E.I. DuPont de Nemours & Company was evaluated using the method described on page 6, lines 4 to 11. The fiber diameter changed less than 10% when the evaluation was carried out at 150° C. The fibers were found to be non-fusing. See Example 5 of U.S. Pat. App. Pub. No. 2010/0272994 (Carlson et al.).

A microsphere-fiber mixture was prepared by adding the following materials to a 1-liter plastic beaker: 30 g of "3M GLASS BUBBLES K15" microspheres (density of 0.15 g/mL), 3.0 g of multi-component fibers, 5.7 g of "ARALDITE PZ-323" epoxy resin dispersion (76.5% solids), 0.48 g of "Z-6137" aminoethylaminopropyl-silane triol homopolymer (24% solids), and 150 g of deionized water. The mixture was hand mixed until the multi-component fibers were fully dispersed. The mixture was then poured into a 0.5 in (1.27 cm) deep, 8 in by 8 in (20.3 cm by 20.3 cm) aluminum casting mold lined with aluminum foil. The aluminum foil was folded over the mixture and the mold cover placed on top of the foil. Four C-clamps were placed on the 4 corners of the mold to compress it. The casting mold was then placed in a preheated oven at 300° F. (149° C.) for 60 minutes to consolidate a microsphere-fiber composite. Upon cooling, the composite was removed from the mold. The composite was further dried at the same temperature for 60 minutes. Weight and volume loading of the composite are shown in Table 2, below.

TABLE 2

| | Weight (g) | Weight loading (%) | Volume loading (%) |
|---|---|---|---|
| Multi-component fibers | 3 | 7.6 | 1.4 |
| microspheres | 30 | 76.5 | 95.6 |
| Epoxy resin dispersion | 5.7 | 14.6 | 2.7 |
| "Z-6137" | 0.48 | 1.2 | 0.2 |

Density of the microsphere-fiber composite was 0.107 g/mL. The microsphere-fiber composite with aluminum foil was submitted to the vertical burn test described above and passed. In the horizontal burn test, the flame self-extinguished in 10 seconds.

Thermal conductivity was measured as described above. Results are reported in Table 3, below.

TABLE 3

| Mean Temperature (° C.) | Thermal Conductivity (W/mK) |
|---|---|
| 10 | 0.0386 |
| 30 | 0.0409 |
| 50 | 0.0433 |
| 60 | 0.0444 |

Example 2

A microsphere-fiber composite was prepared as described in Example 1, except that the microsphere-fiber mixture comprised: 20 g of "3M GLASS BUBBLES K15" microspheres, 5 g of multi-component fibers, 2 g of "Z-6137", and 300 g of water. Weight and volume loading of the microsphere-fiber composite are shown in Table 4, below.

TABLE 4

| | Weight (g) | Weight loading (%) | Volume loading (%) |
|---|---|---|---|
| Multi-component fibers | 5 | 19.62 | 3.53 |
| Microspheres | 20 | 78.49 | 96.12 |
| "Z-6137" | 2 | 1.88 | 0.35 |

Example 3

A microsphere-fiber composite was prepared as described in Example 1, except that the microsphere-fiber mixture comprised: 20 g of "3M GLASS BUBBLES K15" microspheres, 5 g of multi-component fibers, 10 g of acrylic emulsion, and 300 g of water. Weight and volume loading of the microsphere-fiber composite are shown in Table 5, below.

TABLE 5

| Materials | Weight (g) | Weight loading (%) | Volume loading (%) |
|---|---|---|---|
| Multi-component fibers | 5 | 17.2 | 3.45 |
| microspheres | 20 | 69.0 | 93.7 |
| acrylic emulsion | 10 | 13.8 | 2.8 |

Example 3 was submitted to the horizontal burn test method, and the flame self-extinguished in 13 seconds. Examples 2 and 3 were submitted to the thermal conductivity test, as described above. Results are reported in Table 6, below.

TABLE 6

| Mean | Thermal Conductivity (W/mK) | |
|---|---|---|
| Temperature (° C.) | Example 2 | Example 3 |
| 10 | 0.0359 | 0.0355 |
| 30 | 0.0383 | 0.0377 |
| 50 | 0.0407 | 0.0401 |
| 60 | 0.0418 | 0.0413 |

Example 4

A microsphere-fiber composite was prepared as described in Example 1, except that the microsphere-fiber mixture comprised: 2.9 g of "3M GLASS BUBBLES K15" microspheres, 0.73 g of multi-component fibers, 0.58 g of acrylic emulsion, and 43.50 g of water. Weight and volume loading of the microsphere-fiber composite are shown in Table 7, below.

TABLE 7

| Materials | Weight (g) | Weight loading (%) | Volume loading (%) |
|---|---|---|---|
| Multi-component fibers | 0.73 | 18.9 | 3.5 |
| Microspheres | 2.90 | 75.1 | 95.3 |
| Acrylic emulsion | 0.58 | 6.0 | 1.1 |

Example 5

A microsphere-fiber composite was prepared as described in Example 4, except that a 0.0625 in (0.16 cm) thick layer of multi-component fibers was disposed adjacent the microsphere-fiber composite. The layer was prepared by air-laying fibers, making a web having web density of about 200 g/m$^2$. The web was thermally bonded through a 5.5-meter long drying oven set at 120° C. The drying oven comprised a conveyer belt set to a speed of 1 m/min. At the end of the drying oven, a press roller was used to set the final thickness of the web to 0.0625 inch (0.16 cm). The composite was then heated to 275° F. (135° C.) for 30 minutes in a preheated oven.

Example 6

A microsphere-fiber composite was prepared as described in Example 1, except that the microsphere-fiber mixture comprised: 2.9 g of "3M GLASS BUBBLES K15" microspheres, 1.45 g of multi-component fibers, 0.07 g of acrylic emulsion, and 43.50 g of water. Weight and volume loading of the microsphere-fiber composite are shown in Table 8, below.

TABLE 8

| Materials | Weight (g) | Weight loading (%) | Volume loading (%) |
|---|---|---|---|
| Multi-component fibers | 1.45 | 33.1 | 6.5 |
| Microspheres | 2.90 | 66.2 | 93.0 |
| Acrylic emulsion | 0.07 | 0.64 | 0.13 |

Acoustic transmission loss for Examples 4, 5 and 6 was measured as described above. Results are reported in Table 9, below.

TABLE 9

| | Transmission Loss (dB) | | |
|---|---|---|---|
| Frequency (Hz) | Example 4 | Example 5 | Example 6 |
| 400 | 8.7 | 16.9 | 35.4 |
| 700 | 10.8 | 15.6 | 28.7 |
| 1100 | 11.9 | 14.9 | 20.0 |
| 1500 | 13.0 | 17.3 | 22.4 |
| 2000 | 14.6 | 19.3 | 27.2 |
| 2500 | 16.4 | 20.6 | 30.2 |
| 3000 | 18.3 | 22.9 | 32.9 |

Example 7

The following materials were added to a blender: 5 g of multi-component fibers prepared as described in Example 1, 15 g of "3M GLASS BUBBLES K1" microspheres, 50 g of "ISOFRAX" ceramic fibers, 1.5 g of "AIRFLEX 600BP" polymeric dispersion, 0.1 g of "FOAMMASTER 111" defoamer, 0.15 g of "MP 9307C" flocculant, and 3000 g of tap water. With the blender operated on low speed, the microsphere-fiber mixture was blended for 5 minutes. The microsphere-fiber slurry was poured into a hand sheet paper maker which is an 8 in by 8 in (20.3 cm by 20.3 cm) box, 3 in (7.6 cm) deep, equipped with a 200 mesh screen on the bottom, and a bottom valve. Water was evacuated from the paper maker by opening the bottom valve. The resulting microsphere-fiber composite was dried in an oven for 60 minutes at 149° C. Thermal conductivity was measured as described above. Results are reported in Table 10, below.

TABLE 10

| Mean Temperature (° C.) | Thermal Conductivity (W/mK) Example 7 |
|---|---|
| 10 | 0.03531 |
| 30 | 0.03747 |
| 50 | 0.03963 |
| 60 | 0.04070 |

Various modifications and alterations to this disclosure will become apparent to those skilled in the art without departing from the scope and spirit of this disclosure. It should be understood that this disclosure is not intended to be unduly limited by the illustrative embodiments and examples set forth herein and that such examples and embodiments are presented by way of example only with the scope of the disclosure intended to be limited only by the claims set forth herein as follows.

What is claimed is:

1. An article comprising:

multi-component fibers having external surfaces and comprising at least a first polymeric composition and a second polymeric composition, wherein at least a portion of the external surfaces of the multi-component fibers comprises the first polymeric composition, wherein the multi-component fibers:

are core-sheath fibers with a core comprising the second polymeric composition, and a sheath comprising the first polymeric composition surrounding the core; or are pie-wedge fibers comprising at least first and second wedges, wherein the first wedges comprise the first polymeric composition and the second wedges comprise the second polymeric composition, and wherein the multi-component fibers are autogenously bonded together at junction points with little or no flow of the first polymeric composition so that the sheath or the first wedges, respectively, are retained along the majority of the multi-component fibers; and hollow ceramic microspheres adhered at least to the first polymeric composition on the external surfaces of at least some of the multi-component fibers, wherein the hollow ceramic microspheres are present at a level of at least 70 percent by volume, based on the total volume of components of the article.

2. The article of claim 1, wherein the article does not comprise a continuous polymer matrix.

3. The article of claim 1, wherein the hollow ceramic microspheres are directly attached to the first polymeric composition on the external surfaces of the multi-component fibers.

4. The article of claim 1, wherein the first polymeric composition has a softening temperature of up to 150° C., wherein the second polymeric composition has a melting point of at least 130° C., and wherein the difference between the softening temperature of the first polymeric composition and the melting point of the second polymeric composition is at least 10° C.

5. The article of claim 1, wherein the first polymeric composition has an elastic modulus of less than $3\times10^5$ N/m$^2$ at a temperature of at least 80° C. measured at a frequency of one hertz.

6. The article of claim 1, wherein the multi-component fibers are non-fusing at a temperature of at least 110° C.

7. The article of claim 1, wherein the hollow ceramic microspheres are present at a level of at least 95 percent by volume, based on the total volume of components of the article.

8. The article of claim 1, wherein the hollow ceramic microspheres are glass microbubbles or perlite microspheres.

9. The article of claim 1, wherein the article has a density of up to 0.5 grams per cubic centimeter.

10. The article of claim 1, further comprising an adhesion promoter.

11. The article of claim 1, further comprising a polymer not included in the multi-component fibers, wherein the polymer is present in an amount up to 5 percent by volume, based on the total volume of the article.

12. The article of claim 1, further comprising additional fibers different from the multi-component fibers, wherein the additional fibers optionally comprise at least one of cellulose fibers, glass fibers, or ceramic fibers.

13. A method of making an article of claim 1, the method comprising:

providing a mixture of hollow ceramic microspheres and multi-component fibers, the multi-component fibers comprising at least a first polymeric composition and a second polymeric composition; and heating the mixture to a temperature at which the multi-component fibers are non-fusing and at which the first polymeric composition has an elastic modulus of less than $3\times10^5$ N/m$^2$ measured at a frequency of one hertz.

14. The method of claim 13, wherein before the heating, the mixture is positioned in contact with an article to be insulated.

15. The method of claim 14, wherein the mixture provides at least one of thermal insulation, electrical insulation, or acoustic insulation to the article to be insulated.

16. The method of claim 13, wherein the first polymeric composition has a softening temperature of up to 150° C., wherein the second polymeric composition has a melting point of at least 130° C., and wherein the difference between the softening temperature of the first polymeric composition and the melting point of the second polymeric composition is at least 10° C.

17. The method of claim 13, wherein the multi-component fibers are in a range from 3 millimeters to 60 millimeters in length and in a range from 10 to 100 micrometers in diameter.

18. The method of claim 13, wherein the hollow ceramic microspheres are glass microbubbles or perlite microspheres.

19. The article of claim 1, wherein the multi-component fibers are in a range from 3 millimeters to 60 millimeters in length and in a range from 10 to 100 micrometers in diameter.

20. The article of claim 1, wherein the multi-component fibers:

are core-sheath fibers with a core comprising the second polymeric composition, and a sheath comprising the first polymeric composition surrounding the core; or are core-sheath fibers with a plurality of cores comprising the second polymeric composition, and a sheath comprising the first polymeric composition surrounding the plurality of cores.

* * * * *